US009334452B2

(12) United States Patent
Cash et al.

(10) Patent No.: US 9,334,452 B2
(45) **Date of Patent: *May 10, 2016**

(54) TWO-STAGE, CLOSE-COUPLED, DUAL-CATALYTIC HEAVY OIL HYDROCONVERSION PROCESS

(75) Inventors: Dennis R. Cash, Novato, CA (US); Graham J. Forder, San Rafael, CA (US); David S. Mitchell, San Rafael, CA (US); Joe W. Rosenthal, Lafayette, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 833 days.

This patent is subject to a terminal disclaimer.

(21) Appl. No.: 13/134,604

(22) Filed: Jun. 10, 2011

(65) Prior Publication Data

US 2012/0067775 A1 Mar. 22, 2012

Related U.S. Application Data

(60) Provisional application No. 61/384,572, filed on Sep. 20, 2010, provisional application No. 61/360,259, filed on Jun. 30, 2010.

(51) Int. Cl.

| | |
|---|---|
| ***C10G 65/12*** | (2006.01) |
| ***C10G 1/06*** | (2006.01) |
| ***C10G 65/02*** | (2006.01) |
| ***C10G 65/10*** | (2006.01) |
| ***C10G 1/00*** | (2006.01) |
| ***C10G 47/10*** | (2006.01) |
| ***C10G 69/04*** | (2006.01) |
| ***C10G 11/18*** | (2006.01) |

(52) U.S. Cl.

CPC ..... *C10G 65/12* (2013.01); *C10G 1/002* (2013.01); *C10G 11/18* (2013.01); *C10G 47/10* (2013.01); *C10G 65/02* (2013.01); *C10G 65/10* (2013.01); *C10G 69/04* (2013.01); *C10G 2300/107* (2013.01); *C10G 2300/1074* (2013.01); *C10G 2300/1077* (2013.01); *C10G 2300/205* (2013.01); *C10G 2300/206* (2013.01); *C10G 2300/301* (2013.01)

(58) Field of Classification Search

CPC ..... C10G 65/02; C10G 65/10; C10G 65/12
USPC ..... 208/57–59, 68, 89
See application file for complete search history.

(56) References Cited

U.S. PATENT DOCUMENTS 4,054,504 A * 10/1977 Chervenak et al. ..... 208/408
4,391,699 A 7/1983 Rosenthal (Continued)

OTHER PUBLICATIONS

International Search Report from corresponding PCT Application PCT/US2012/023578 mailed Sep. 27, 2012.

*Primary Examiner* — Renee E Robinson
(74) *Attorney, Agent, or Firm* — Melissa M. Hayworth; Steven R. Ellinwood; Susan M. Abernathy

(57) ABSTRACT

A process for the production of high yields of high quality products from heavy hydrocarbonaceous feedstock is provided comprising a two-stage, close-coupled process, wherein the first stage comprises a thermal-catalytic zone into which is introduced a mixture comprising the feedstock, coal, dispersed catalyst, and hydrogen; and the second, close-coupled stage comprises a catalytic-hydrotreating zone into which substantially all the effluent from the first stage is directly passed and processed under hydrotreating conditions.

24 Claims, 1 Drawing Sheet

Two-stage, close-coupled, dual-catalytic heavy oil hydroconversion process

INVENTORS
Cash; Dennis R. (Novato, CA)
Forder; Graham J. (San Rafael, CA)
Mitchell; David S. (San Rafael, CA)
Rosenthal; Joe W. (Lafayette, CA)
ASSIGNEE
4CRGroup (San Rafael, CA)

(56) References Cited

U.S. PATENT DOCUMENTS

| | | | | |
|---|---|---|---|---|
| 4,422,922 | A | | 12/1983 | Rosenthal et al. |
| 4,564,439 | A | * | 1/1986 | Kuehler et al. ..... 208/59 |
| 4,591,426 | A | | 5/1986 | Krasuk et al. |
| 4,761,220 | A | | 8/1988 | Beret et al. |
| 4,842,719 | A | | 6/1989 | Macarthur et al. |
| 4,851,107 | A | | 7/1989 | Kretschmar et al. |
| 5,166,118 | A | | 11/1992 | Kretschmar et al. |
| 5,871,638 | A | | 2/1999 | Pradhan et al. |
| 6,544,409 | B2 | | 4/2003 | De Souza |

* cited by examiner

Two-stage, close-coupled, dual-catalytic heavy oil hydroconversion process
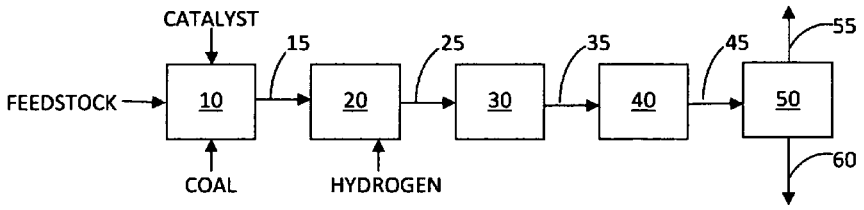
INVENTORS
Cash; Dennis R. (Novato, CA)
Forder; Graham J. (San Rafael, CA)
Mitchell; David S. (San Rafael, CA)
Rosenthal; Joe W. (Lafayette, CA)
ASSIGNEE
4CRGroup (San Rafael, CA)

TWO-STAGE, CLOSE-COUPLED, DUAL-CATALYTIC HEAVY OIL HYDROCONVERSION PROCESS

CROSS-REFERENCE TO RELATED APPLICATIONS

This application claims priority to U.S. Provisional Application Ser. No. 61/360,259, filed 30 Jun. 2010 and to U.S. Provisional Application Ser. No. 61/384,572, filed 20 Sep. 2010.

BACKGROUND OF THE INVENTION

Various processes for the conversion of heavy hydrocarbonaceous fractions, particularly, multi-stage conversion processes include U.S. Pat. No. 4,761,220, Beret et al.; U.S. Pat. No. 4,564,439, Kuehler et al.; U.S. Pat. No. 4,330,393, Rosenthal et al.; U.S. Pat. No. 4,422,922, Rosenthal et al.; U.S. Pat. No. 4,354,920, Rosenthal et al; U.S. Pat. No. 4,391,699, Rosenthal et al.

The present invention relates to a process for the hydroconversion of heavy hydrocarbonaceous fractions of petroleum. In particular, it relates to a close-coupled two-stage; thermal-catalytic, catalytic-hydrotreatment process for petroleum residua having improved effectiveness for high conversion and control of condensation reactions thereby producing stable high-quality products.

Increasingly, petroleum refiners find a need to make use of heavier or poorer quality crude feedstocks in their processing. As that need increases, the need also grows to process the fractions of those poorer feedstocks boiling at elevated temperatures, particularly those temperatures above 1000.degree. F. High conversions to stable, quality products are desirable in order to avoid producing significant quantities of low value fuel oil.

Severe conditions are required in order to achieve high conversions which while producing desirable lighter fractions can also produce thermally cracked fragments and unstable asphaltenes that form mesophase masses. Unless controlled, the cracked fragments can undergo condensation reactions to undesirable polycyclic molecules which tend to be unstable and difficult to process into desirable products. Along with the mesophase masses, they can also lead to coke formation.

It is the intention of the present invention to overcome these problems in a two-stage process which uses coal and a dispersed catalyst in a first stage thermal-catalytic reaction zone which is close-coupled to a second stage catalytic-hydrotreating zone. In the thermal-catalytic zone, the dispersed catalyst catalyses the hydrogenation of thermally cracked fragments and stabilizes them thus preventing condensation reactions. The dispersed catalyst also re-hydrogenates coal liquids which in a non-catalytic process also act to hydrogenate thermally cracked fragments by donating hydrogen to them. The coal liquids also act to solubilize asphaltenes and asphaltenes precursors and inhibit the formation of mesophase masses. The close-coupled catalytic-hydrotreater plays a key role in promptly stabilizing remaining thermally cracking fragments from the first stage, hydrogenating products, removing heteroatoms and effecting some further molecular weight reduction. The unconverted coal and coal ash sequester the metals in the feedstock in the first stage thermal-catalytic zone which results in substantial reduction of metals fouling of the supported hydrotreating catalyst in the catalytic-hydrotreating stage.

BRIEF SUMMARY OF THE INVENTION

In accordance with the present invention, there is provided a process for converting the portion boiling above 1000 degree F. of a heavy hydrocarbonaceous feedstock to produce high yields of high quality products boiling below 1000 degrees F. Compared to existing processes, these products are reduced in heteroatom content, reduced in condensed molecules and are more readily processed to finished fuels.

The process comprises introducing a mixture comprising the feedstock and coal and dispersed catalyst particles, into a first-stage thermal-catalytic zone in the presence of hydrogen. The feedstock, coal and dispersed catalyst mixture is introduced essentially upward into the thermal-catalytic zone under conditions sufficient to substantially convert a significant amount of hydrocarbons in the feedstock boiling above 1000.degree. F. to hydrocarbons boiling below 1000.degree. F.

Substantially all or at least a substantial portion of the effluents of the first-stage thermal-catalytic zone is readily passed directly in a close-coupled manner, into a second-stage catalytic-hydrotreating reaction zone at a reduced temperature relative to the first-stage thermal-catalytic zone. The effluent is contacted with hydrotreating catalysts under hydrotreating conditions, and the effluent from said second-stage catalytic-hydrotreating reaction zone is recovered.

Alternatively, the coal and dispersed catalyst particles are dispersed within the hydrocarbonaceous feedstock, hydrogen is added, and the resultant slurry is heated to a temperature in the range of between 750.degree. F. to 900.degree. F. The heated slurry is then introduced into the first-stage thermal-catalytic zone in an essentially upward manner, and the processing proceeds as summarized above.

BRIEF DESCRIPTION OF THE SEVERAL VIEWS OF THE INVENTION

FIG. 1 is a block flow diagram of suitable flow paths for use in practicing one embodiment of the present invention.

DETAILED DESCRIPTION OF THE INVENTION

The present invention is directed to a process for the hydroprocessing of heavy hydrocarbonaceous feed-stocks, a significant portion of which boils above 1000.degree. F., to produce high yields of transportation fuels boiling below 680.degree. F. The process is a two-stage, close-coupled process, the first stage of which encompasses a thermal-catalytic zone 20, wherein the feedstock is substantially converted to lower boiling products. Some hydrogenation, substantial control of condensation reactions, minimization of asphaltene coalescence to mesophase masses, and demetalation also occur in the first-stage thermal-catalytic zone, which would otherwise lead to coke formation. The effluent 25 from the thermal-catalytic zone is then cooled 30 and is passed directly and without substantial loss of hydrogen partial pressure into a catalytic-hydrotreating zone 40, wherein the cooled thermal-catalytic zone effluent 35 is hydrotreated to produce an effluent 45 suitable for further treatment into transportation fuels.

The feedstock finding particular use within the scope of this invention is any heavy hydrocarbonaceous feedstock, at least 30 volume percent, preferably 50 volume percent of which boils above 1000.degree. F. Examples of typical feedstocks include crude petroleum, topped crude petroleum, reduced crudes, petroleum residua from atmospheric or vacuum distillations, vacuum gas oils, solvent deasphalted tars and oils, and heavy hydrocarbonaceous liquids including residua derived from coal, bitumen, or coal tar pitches.

Typical heavy hydrocarbonaceous feedstocks contain very high and undesirable amounts of metallic contaminants. Unless removed, these contaminants result in deactivation of the second stage hydrotreating catalyst, and/or plugging of the catalyst bed resulting in an increase in the pressure drop in the bed of supported hydrotreating catalyst. The present invention is well suited for the processing of feeds that are high in metallic contaminants because most of these contaminants are removed from the feed and deposited on undissolved coal and ash. The present invention is also particularly well suited for feeds that are derived from crudes that are high in residuum content, especially those that are also high in contaminants, since high quality products can be obtained from these lower cost crudes.

In the preferred embodiment of the present invention, coal and dispersed catalyst particles are mixed in mixing zone 10 with the heavy hydrocarbonaceous feed to form a slurry, preferably a dispersion or uniform distribution of particles within the feed 15, which is introduced into a first-stage thermal-catalytic reactor 20.

The coal is present in the mixture in a concentration relative to the feedstock up to 20.0 percent by weight, preferably up to 10.0 percent by weight and more preferably up to 5.0 percent by weight. Due to their high hydroaromatic content and ease of liquefaction, High Volatile Bituminous coals are preferred, but coals of other rank may be suitable. The coal particles should be finely divided, having a maximum diameter of about 40 mesh U.S. sieve series, and preferably under 100 mesh.

The dispersed catalyst is present in the mixture in a concentration relative to the feedstock of from about 0.1 to 5.0 percent by weight, preferably 0.5 to 1.0 percent by weight. Suitable dispersed catalyst particles would be the oxides or sulfides of metals selected from Groups VIb, VIIb and VIIIb. The dispersed catalyst could be either synthetic or naturally occurring such as limonite. The particles should also be finely divided, having a maximum diameter of about 40 mesh U.S. sieve series, and preferably under 100 mesh.

The feedstock-particulate mixture is introduced into the first-stage thermal-catalytic zone. Hydrogen is also introduced co-currently to the flow of the feedstock-particulate slurry, and may constitute either fresh hydrogen, recycled gas, or a mixture thereof. The feed preferably flows upwardly in the thermal-catalytic reaction zone.

Prior to introduction into the first-stage thermo-catalytic zone, the feedstock slurry and hydrogen-containing streams are heated to provide a temperature of between 750.degree. F. to 900.degree. F., preferably 800.degree. F. to 875.degree. F, in the zone. This heating may be done to the entire feed to the zone or may be accomplished by segregated heating of the various components or combinations of the components of the total feed (feed-solids slurry, feed-hydrogen, feed only, gas only).

Other reaction conditions in the thermal-catalytic zone include a residence time of from 0.5 to 3 hours, preferably 0.5 to 1.5 hours; a hydrogen partial pressure in the range of 35 to 300 atmospheres, preferably 100 to 200 atmospheres, and more preferably 100 to 175 atmospheres; and a hydrogen gas rate of 350 to 3000 liters per liter of feed mixture and preferably 400 to 2000 liters per liter of feed mixture. Under these conditions, a significant amount of the hydrocarbons in the feedstock boiling above 1000.degree. F. is converted to hydrocarbons boiling below 1000.degree. F. In this embodiment, the percentage of hydrocarbons boiling above 1000.degree. F. converted to those boiling below 1000.degree. F. are at least 50 percent, more preferably 75 percent and most preferably more than 90 percent.

The effluent 25 from the thermal-catalytic reactor zone is directly and rapidly passed through a cooling zone 30 and the effluent 35 from the cooling zone is passed into a second-stage catalytic-hydrotreating reaction zone 40. In this invention, the two stages or zones are close-coupled, referring to the connective relationship between those zones. In this close-coupled system, the pressure between the thermal-catalytic zone and the catalytic-hydrotreating zone is maintained such that there is no substantial loss of hydrogen partial pressure. In a close-coupled system also, there is preferably no solids separation effected on the feed as it passes from one zone to the other, and there is no more cooling and reheating than necessary. However, it is preferred to cool the first-stage effluent by passing it through a cooling zone prior to the second stage. This cooling does not affect the close-coupled nature of the system. The cooling zone will typically contain a heat exchanger or similar means, whereby the effluent from the thermal-catalytic reactor zone is cooled to a temperature between 600-800.degree. F. Some cooling may also be effected by the addition of a fresh, cold hydrogen-rich stream if desired.

The catalytic-hydrotreating reaction zone is either a fixed, ebullating, or moving bed.

The catalyst used in the catalytic-hydrotreating zone may be any of the well-known, commercially available hydroprocessing catalysts. A suitable catalyst for use in this reaction zone comprises a hydrogenation component supported on a suitable refractory base. Suitable bases include silica, alumina, or a composite of two or more refractory oxides. Suitable hydrogenation components are selected from Group VI-B metals, Group VIII metals and their oxides, sulfides or mixture thereof. Particularly useful are cobalt-molydenum, nickel-molybdenum, or nickel-tungsten.

In the catalytic-hydrotreating reaction zone, predominately hydrogenation occurs which further stabilizes unstable molecules from the thermal-catalytic zone and also removes heteroatoms such that the product will also have been substantially desulfurized, denitrified, and deoxygenated. Some cracking also occurs simultaneously, such that some higher-molecular-weight compounds are converted to lower-molecular-weight compounds.

In the process conditions of the catalytic-hydrotreating zone, it is preferred to maintain the temperature below 800.degree. F., preferably in the range of 600.degree. F. to 800.degree. F., and more preferably between 650.degree. F. to 780.degree. F. to prevent catalyst fouling. Other hydrocatalytic conditions include a hydrogen partial pressure from 35 atmospheres to 300 atmospheres, preferably 100 to 200 atmospheres, and more preferably 100 to 175 atmospheres; a hydrogen flow rate of 300 to 1500 liters per liter of feed mixture, preferably 350 to 1000 liters per liter of feed mixture; and a residence time in the range of 0.5 to 4 hours, preferably 0.5 to 3 hours.

Preferably, the entire effluent from the thermal-catalytic zone is passed to the catalytic-hydrotreating zone. However, in some embodiments, it may be desirable to remove a portion of the gas that is present in the thermal-catalytic zone. Since small quantities of water and light gases (C.sub.1 to C.sub.4) are produced in the thermal-catalytic zone, the catalyst in the catalytic-hydrotreating zone may be subjected to a slightly lower hydrogen partial pressure than if these materials were absent. Since higher hydrogen partial pressures tend to increase catalyst life, while maintaining the close-coupled nature of the system, it may be desired to remove a portion of the water and light gases before the stream enters the catalytic-hydrotreating zone and replace them with hydrogen. Furthermore, interstage removal of the carbon monoxide and other oxygen-containing gases may reduce the hydrogen consumption in the catalytic-hydrotreating stage due to the reduction of carbon oxides. The removal of gas from the thermal-catalytic zone might also be done to provide improved hydrodynamics in the downstream catalytic-hydrotreating zone. In any case, the removal of gas is to be done in a manner that does not cause significant delay in the movement of liquids from the thermal-catalytic zone to the catalytic-hydrotreating zone where the process conditions are more favorable for the stabilization of heavy hydrocarbon molecules.

The product effluent 45 from the catalytic-hydrotreating reaction zone may be separated in zone 50 into a gaseous fraction 55 and a liquids-solids fraction 60. Preferably, a hydrogen-rich stream is separated from the other gaseous components and recycled to the thermal-catalytic or catalytic-hydrotreating stages. The liquids-solids fraction may be fed to a solid separation zone, wherein the insoluble solids are separated from the liquid by conventional means, for example, distillation, hydroclones, filters, centrifugal separators, cokers and gravity settlers, or any combination of these means. As an alternative to complete liquid-solid separation, it may be attractive to recover most of the liquid products as solids-free products, while discharging some of the liquid as part of a solids-rich slurry.

The process of the present invention produces liquid products, a significant portion of which boils below 680.degree. F. and which is suitable for use as transportation fuels. The normally liquid products, that is, all of the product fractions boiling above C.sub.4, have a specific gravity in the range of naturally occurring petroleum stocks. Additionally, the product will have at least 80 percent of sulfur removed and at least 30 percent of nitrogen removed. The process may be adjusted to produce the type of liquid products that are desired in a particular boiling point range. Additionally, those products boiling in the transportation fuel range may require additional upgrading or clean up prior to use as a transportation fuel.

The invention claimed is:

1. A two-stage, close-coupled process for converting a portion boiling above 1000 degree F. of a heavy hydrocarbonaceous feedstock to produce high yields of high quality fuels boiling below 1000 degrees F. comprising:

a. forming a slurry by dispersing within said feedstock
   i. finely divided coal particles in a concentration relative to said feedstock of up to 10.0 percent by weight and
   ii. finely divided dispersed catalyst particles in a concentration relative to said feedstock of from about 0.1 to 5.0 percent by weight having activity in the presence of hydrogen;

b. introducing said slurry into a first-stage thermal-catalytic reaction zone under conditions sufficient to convert a portion of the finely divided coal particles into coal liquids;

c. mixing the coal liquids, the finely divided dispersed catalyst particles, and the feedstock in the first-stage thermal-catalytic reaction zone to convert a significant amount of the hydrocarbons in said feedstock boiling above 1000.degree. F. to hydrocarbons boiling below 1000.degree. F. to provide a converted effluent;

d. rapidly and without substantial reduction of pressure passing a substantial portion of the converted effluent of said first-stage thermal-catalytic reaction zone directly into a second-stage catalytic-hydrotreating reaction zone at a reduced temperature relative to said first-stage thermal-catalytic reaction zone;

e. contacting said converted effluent with a supported hydroprocessing catalyst under hydrotreating conditions, including a temperature in the range of 600.degree. F. to 800.degree. F.; and f. recovering an effluent comprising hydrocarbons boiling below 1000 degrees F. from said second-stage catalytic-hydrotreating reaction zone.

2. The process as claimed in claim 1 wherein substantially all of the converted effluent from said first-stage thermal-catalytic reaction zone is passed into said second-stage catalytic-hydrotreating reaction zone.

3. The process as claimed in claim 1 wherein the dispersed catalyst particles in the first-stage thermal-catalytic reaction zone are not supported on a base and are oxides or sulfides of metals selected from the group consisting of Group VIb, VIIb and VIIIb metals.

4. The process as claimed in claim 1 wherein the dispersed catalyst particles in the first-stage thermal-catalytic reaction zone are not supported on a base and are either a synthetic catalyst or a naturally occurring material.

5. The process as claimed in claim 1 wherein the temperature of said first-stage thermal-catalytic reaction zone is maintained within a range of between 750.degree. F. and 900.degree. F.

6. The process as claimed in claim 1 wherein the temperature of said first-stage thermal-catalytic reaction zone is maintained within a range of between 800.degree. F. and 875.degree. F.

7. The process as claimed in claim 1 wherein the temperature of said second stage catalytic-hydrotreating reaction zone is within a range between 650.Degree. F. and 780.Degree. F.

8. The process as claimed in claim 1 wherein said slurry is introduced into said first-stage thermal-catalytic reaction zone in an upward manner.

9. The process as claimed in claim 1 wherein the percentage of hydrocarbons in the feedstock boiling above 1000.degree. F. converted to hydrocarbons boiling below 1000.degree. F. is at least 50 percent.

10. The process as claimed in claim 1 wherein the percentage of hydrocarbons in the feedstock boiling above 1000.degree. F. converted to hydrocarbons boiling below 1000.degree. F. is at least 75 percent.

11. The process as claimed in claim 1 wherein the percentage of hydrocarbons in the feedstock boiling above 1000.degree. F. converted to hydrocarbons boiling below 1000.degree. F. is at least 90 percent.

12. The process as claimed in claim 1 wherein said heavy hydrocarbonaceous feedstock is crude petroleum, topped crude petroleum, reduced crudes, petroleum residua from atmospheric or vacuum distillations, vacuum gas oils, solvent deasphalted tars and oils, or heavy hydrocarbonaceous liquids.

13. The process as claimed in claim 1 wherein the concentration of said coal particles relative to said feedstock is up to 5.0 percent by weight.

14. The process as claimed in claim 1 wherein the concentration of said dispersed catalyst particles relative to said feedstock is from 0.5 to 1.0 percent by weight.

15. The process as claimed in claim 1 wherein the residence time of the slurry in the first-stage thermal-catalytic reaction zone is from 0.5 to 3 hours.

16. The process as claimed in claim 1 wherein the residence time of the slurry in the first-stage thermal-catalytic reaction zone is from 0.5 to 1.5 hours.

17. The process as claimed in claim 1 wherein the residence time of a material comprised of said converted effluent and said supported hydroprocessing catalyst in the second-stage catalytic-hydrotreating reaction zone is from 0.5 to 4 hours.

18. The process as claimed in claim 1 wherein the residence time of a material comprised of said converted effluent and said supported hydroprocessing catalyst in the second-stage catalytic-hydrotreating reaction zone is from 0.5 to 3 hours.

19. The process as claimed in claim 1 wherein the supported hydroprocessing catalyst in said second-stage catalytic hydrotreating reaction zone is maintained in a fixed, ebullated or moving bed within the reaction zone.

20. The process as claimed in claim 1 wherein the process is maintained at a hydrogen partial pressure from 35 atmospheres to 300 atmospheres.

21. The process as claimed in claim 1 wherein the process is maintained at a hydrogen partial pressure between 100 atmospheres and 200 atmospheres.

22. The process as claimed in claim 1 wherein the process is maintained at a hydrogen partial pressure between 100 atmospheres and 175 atmospheres.

23. The process as claimed in claim 1, further comprising converting a portion of the finely divided coal particles into coal ash in the first-stage thermal-catalytic reaction zone.

24. The process as claimed in claim 23 further comprising substantially removing metal contaminants in the feedstock in the first stage thermal-catalytic reaction zone by sequestering the metal contaminants with the coal ash.

* * * * *